US006109480A

United States Patent [19]

Monsrud et al.

[11] Patent Number: 6,109,480

[45] Date of Patent: Aug. 29, 2000

[54] LIQUID DISPENSER AND DOCKING STATION FOR MATING CONTAINER

[75] Inventors: Lee J. Monsrud, Inver Grove; Scott R. Olson, Mahtomedi; John P. Furber, Roseville; Troy A. Anderson, Eagan, all of Minn.

[73] Assignee: Ecolab Inc., St. Paul, Minn.

[21] Appl. No.: 09/122,974

[22] Filed: Jul. 27, 1998

[51] Int. Cl.[7] ..... B67D 5/00

[52] U.S. Cl. ..... 222/83; 222/83.5

[58] Field of Search ..... 222/81, 82, 83, 222/83.5, 88, 89, 325, 180, 185.1, 109

[56] References Cited

U.S. PATENT DOCUMENTS

| | | | |
|---|---|---|---|
| 5,086,950 | 2/1992 | Crossdale et al. | 222/88 |
| 5,351,859 | 10/1994 | Jansen | 222/82 |
| 5,351,860 | 10/1994 | Gotoh | 222/82 X |
| 5,425,528 | 6/1995 | Rains et al. | 251/149.1 |
| 5,732,853 | 3/1998 | Ganzeboom et al. | 222/83 X |
| 5,875,921 | 3/1999 | Osgar et al. | 222/82 X |

FOREIGN PATENT DOCUMENTS

| | | |
|---|---|---|
| 0369722 | 5/1990 | European Pat. Off. . |
| 2264702 | 9/1993 | United Kingdom . |
| WO 83/00932 | 3/1983 | WIPO . |

*Primary Examiner*—Philippe Derakshani
*Assistant Examiner*—Thach Bui
*Attorney, Agent, or Firm*—Mau & Krull, P.A.

[57] ABSTRACT

A dispensing apparatus 10 includes a container 11 and docking station 20. A needle 35 positioned in a probe 40 which is located on a movable member 45 is guided into a container insert 60 which is positioned in the outlet 12 of the container 11.

15 Claims, 7 Drawing Sheets

LIQUID DISPENSER AND DOCKING STATION FOR MATING CONTAINER

BACKGROUND OF THE INVENTION

1. Field of the Invention

This invention relates generally to an apparatus for dispensing fluid, and more particularly to a dispensing system including a container and a docking station.

2. Description of the Prior Art

It is necessary to dispense liquids for a large number of reasons. One such instance is dispensing chemicals for use in cleaning, such as dishwashing or laundry. For larger commercial or industrial uses, the chemicals are often provided in larger containers. It is then necessary to pump or meter the cleaning solution to the cleaning apparatus. Also, chemicals may be used for cleaning vegetables.

The dispensing of the cleaning fluid is more critical when the chemical being dispensed is very corrosive and harmful for contact with humans. Then, it is necessary to take extra precautions to make certain that the chemical is dispensed without human contact. It is also important to have the chemical in a container that cannot be accessed easily by humans before, during, and after dispensing. One example of such a corrosive chemical that is effective for use in washing is peracetic acid.

One example of the prior art dispenser is found in U.S. Pat. No. 5,086,950. Replaceable containers are placed directly on a receptacle which is a part of a dishwashing machine. The container has an outlet with a self-sealing septum having a slit. A blunt penetrating device enters the slit of the septum and allows for the dispensing of the liquid. However, such a system is not completely closed. The cap and septum on the container may be removed by the user and also the bottle is not sealed. Further, there is no guiding mechanism for the hollow tube which removes the liquid. There is simply a seat which accepts the neck of the bottle and does not provide for accurate alignment when the dimensional tolerances of the bottle neck vary widely.

The present invention addresses the problems associated with the prior art and provides for an apparatus for dispensing chemicals in a safe and efficient manner.

SUMMARY OF THE INVENTION

The present invention is an apparatus for dispensing fluids including a container for holding a liquid product to be dispensed. A docking station receives the container and has a support for holding the container. A pierceable self-sealing septum is operatively connected to the container and a needle is operatively connected to a docking station. The needle has a first end for piercing the septum and for being in fluid communication with the liquid product and a second end for transferring the liquid product out of the container. In the preferred embodiment, the needle is mounted on a movable member with respect to the docking station, whereby the needle is movable as the septum is moved proximate the needle to provide alignment of the needle and septum.

In another embodiment, the invention is an apparatus for dispensing fluids. The apparatus includes a container having a cavity for holding a liquid product to be dispensed and has a pierceable self-sealing septum located proximate the top of the container. A pick-up tube has a first end in fluid communication with the septum and a second end positioned proximate a bottom of the container. A docking station receives the container and has a support for holding the container. A needle is operatively connected to the docking station. The septum is operatively connected to the container, which after the septum is connected to the container, produces a closed system, wherein the needle pierces the septum in a hands-off connection, thereby allowing the liquid product to be pumped out of the container through the needle.

DETAILED DESCRIPTION OF THE PREFERRED EMBODIMENT

Figure 1:
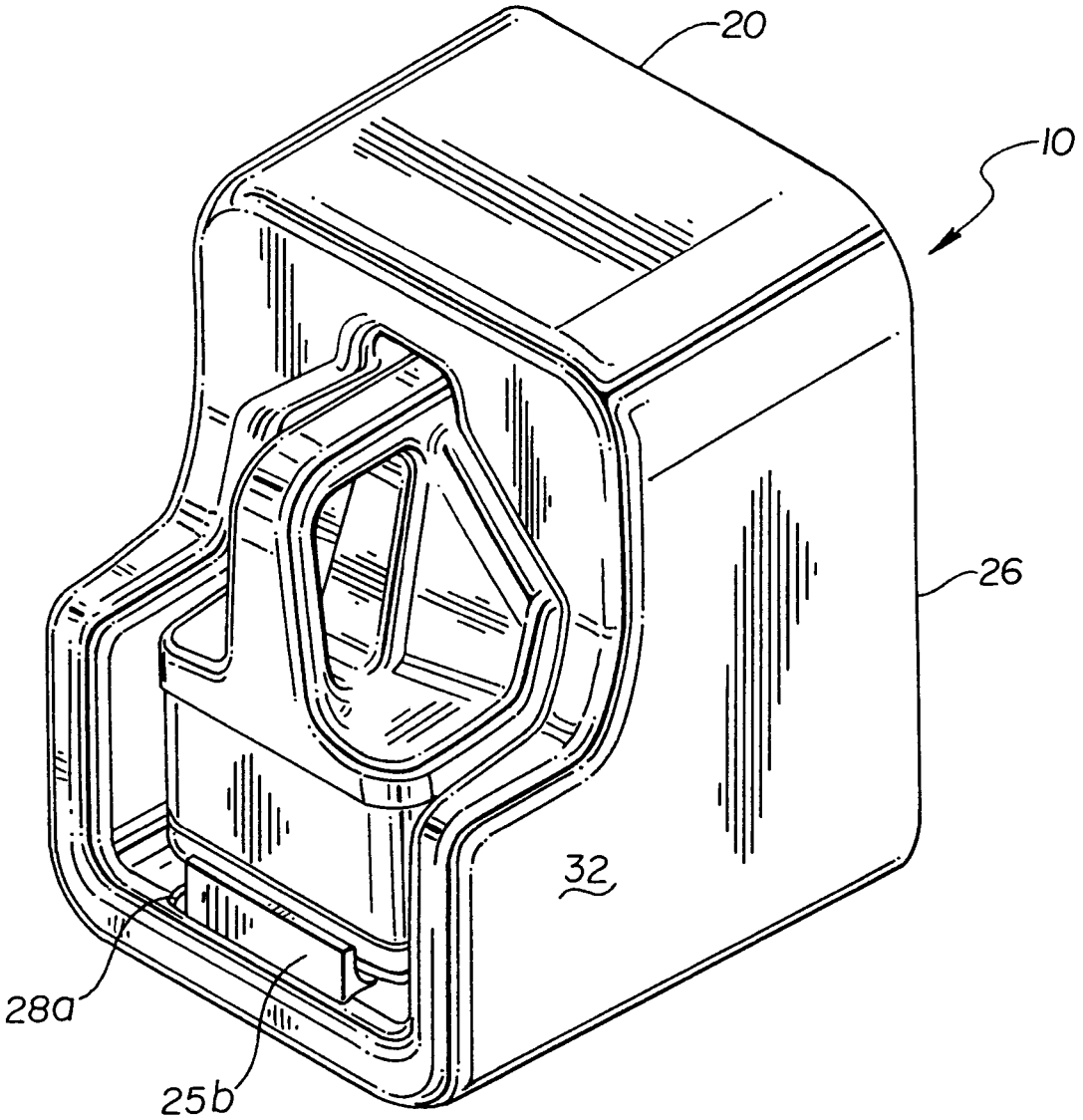
FIG. 1 is a perspective view of the dispensing apparatus according to the present invention.

Referring to the drawings, wherein like numerals represent like parts, there is generally viewed at 10 a dispensing apparatus. The dispensing apparatus 10 includes a container 11 and a docking station 20. The container 11 may be any suitable container to hold a liquid product 19 which is to be dispensed. As shown in the figures, the container 11 is a blow-molded polyethylene container having a handle 11*a* and an inner cavity 11*b* in which the liquid product 19 is placed. The liquid product 19 is filled into the cavity 11*b* through an outlet 12. The outlet 12 is generally circular in cross section and is capped or closed by a container insert 60, which will be described in more detail hereafter. The container 11 has a threaded neck, proximate the outlet, for receiving a threaded cap (not shown).

Figure 10:
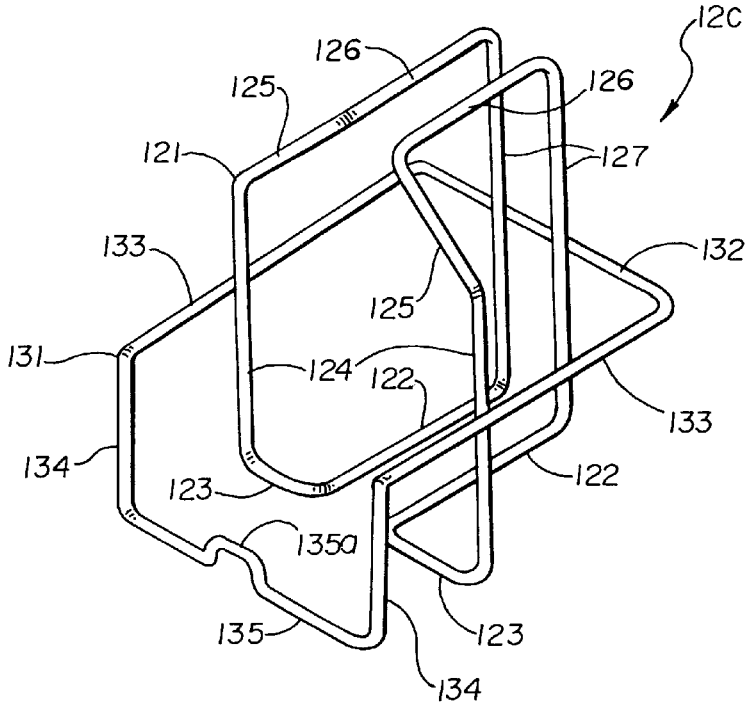
FIG. 10 is a perspective view of a second embodiment of a docking station.

The docking station 20 includes a platform 21 and an optional shell 26. A second embodiment of a docking station is shown in FIG. 10 and will be described in more fully hereafter. The shell 26 forms a recess 26*a* into which the container 11 may be placed. The shell 26 has a bottom member 27 which is connected to a support member 28, which is in turn connected to a back wall 29. The back wall 29 has an opening 29*a*, which allows for access to the outlet 12 of the container 11. The back wall 29 is in turn connected to an inner roof member 30 which is in turn connected to the top 31. Two outer side walls 32 and two inner side walls 33 complete the shell 26. The inner sidewalls 33 form a shape which generally conforms to that of the container 11. An opening 28*a* is formed in the support member 28 to allow for the passage of a latch mechanism 25 which is carried on the platform 21.

The platform 21 includes a support member 22 connected to an upright member 23. The upright member 23 has slotted holes 23*a* which may be used to mount the dispensing apparatus 10 on a mounting surface by means well known in the art. The support member 22 has two downwardly depending side members 22*a,* only one of which is shown. Similarly, the upright member 23 has two side members 23*b*. The side members 22*a* are spot welded to the side members 23*b* to connect the support member to the upright member. However, it is understood that other suitable means may be used. The upright member 23 has a top member 23*c* and a bottom member 23*d*. Preferably, the support member 22 and upright member 23 are formed, with their respective side members and/or top and bottom members from single sheets of metal. The top member 23*c* has apertures 23*e* and the bottom member has similar apertures so that screws 98 and 99 may be inserted through the top 31 and the bottom 27, which have corresponding openings, to secure the docking station 20 to the platform 21. As the shell 26 is inserted in position to be fastened by the screws 98 and 99, the opening 28*a* in the support member 28 is placed over the latch mechanism 25 so that the support member 28 rests on the support member 22. Both support members 22 and 28 are at an angle with respect to the horizontal so that the portion of the bottle away from the container insert 60 is tilted downward. The latch 25 includes two spring steel plates 25*a* which are riveted by four rivets to the support member 22. A stop 25*b* is fastened to the other end of the spring steel plates 25*a*. The stop 25*b* has a curved resting surface 25*c* formed therein for engaging the back of the container 11. The spring steel plate 25*a* is deflected downward by the container 11 as it is placed on the support member 28. Then, once the container passes the curved resting area 25*c,* the spring steel plate 25*a* springs back upward and the stop 25*b* acts as a latch to keep the container 11 in position.

Figure 8:
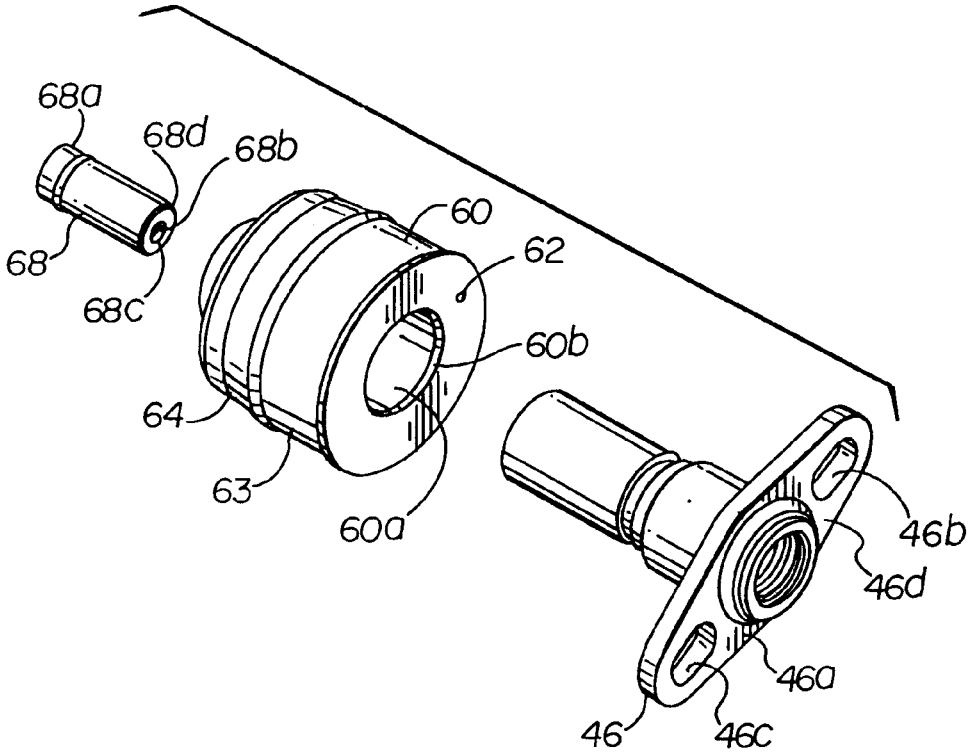
FIG. 8 is an exploded perspective of the probe and container insert.
Figure 9:
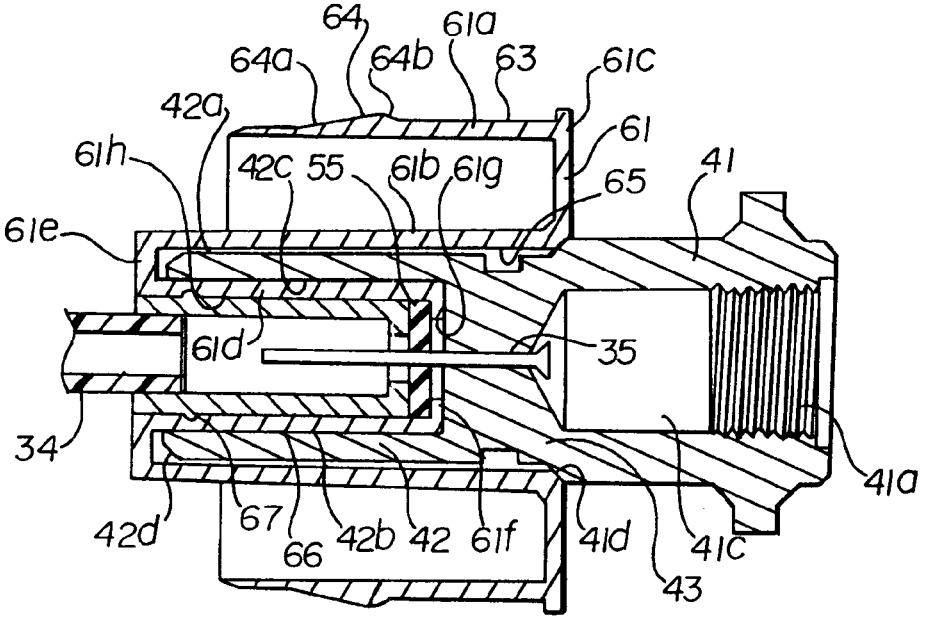
FIG. 9 is a cross-sectional view of the probe and container insert assembled.

The container insert 60 is best shown in FIGS. 8 and 9. The container insert 60 has a cavity 60*a*. A beveled edge 60*b* is formed at one end. A cylindrical tube 61 includes a first cylindrical member 61*a* operatively connected to an intermediate cylindrical member 61*b* by a top section 61*c*. A central cylindrical member 61*d* is operatively connected to the intermediate cylindrical member 61*b* by a bottom section 61*e*. The central cylindrical member 61*d* has a top 61*f* in which an aperture 61*g* is formed. The central cylindrical member 61*d* has a bore 61*h*. Preferably, the cylindrical tube 61 is formed as a single plastic piece, by any suitable method such as injection molding. The top section 61*c* has a vent 62 which provides access into the container 11 between the members 61*a* and 61*b*. Members 61*a* and 61*b* are preferably open at their bottom ends to allow for the vent to be operational. While the vent may be simply a hole to provide air a means of entering the cavity 11*a* as the liquid product 19 is dispensed, the vent 62 is preferably made of a suitable material which allows air to pass but does not allow liquid to pass. A polytetrafluoroethylene, such as Teflon® is a suitable example of such a material, a material from which the well-known Gortex® material is formed. The vent is ultrasonically welded to the HDPE insert 60. The cylindrical tube 61 has an outer wall 63 which is sized to form a friction fit with the outlet 12 of the container 11. A barb 64 is formed on the outer wall 63 and is used to prevent removal of the cylindrical tube 61. The barb 64 is constructed so that it has an incline surface 64*a* to aid in the insertion of the cylindrical tube 61 into the outlet 12 and then has a top latching surface 64*b* which would prevent the removal of the cylindrical tube 61 except by destruction of a portion of the container 11. The cylindrical tube 61 has an inner wall 65. This inner wall acts to accept and align the probe 40 as will be discussed more fully hereafter. The central cylindrical member 61*d* has a probe receiving wall 66 which is sized also for receiving the probe. Formed on the inside surface 67 of the central cylindrical member 61*d* is a recess 67*a*. A cylindrical plug 68 is sized to have a friction fit inside of the central cylindrical member 61*d*. The plug 68 includes a protuberance 68*a* which is formed in the plug 68 and is sized, configured, located, and lock the plug 68 into position in the recess 67. The plug 68 has a hollow core 68*b* and an opening 68*c* formed in the top or receiving end of the plug 68. A septum 55 is positioned between the top 61*f* of the cylindrical member 61*d* and the top 68*d* of the plug 68 thereby fixing in position the septum 55 when the plug 68 is locked in position. This also creates a seal of the septum, i.e., seals the outer edges of the septum. The septum is thus permanently fixed into the insert and cannot be removed without destroying the insert and container.

The septum is primarily a silicone material of a thickness of 0.055" with a 0.003" layer of Teflon® bonded to the silicone. The Teflon® provides the product contact compatibility while the silicone seals around the needle. Other suitable septum materials are rubber or butyl.

A needle 35 is operatively connected inside of a probe 40. The needle is inserted into the mold used to manufacture the probe 40. The needle then becomes an integral part of the probe 40 following the molding process. The probe 40 includes a first cylindrical section 41 and a second cylindrical section 42 operatively connected by an intermediate section 43. The first cylindrical section 41 has a threaded opening 41*a* which is adapted to receive a threaded elbow 18. The threaded elbow 18 has a first end which is threaded into the threaded opening 41*a* and a second end 18*a* which is adapted to be connected to a delivery tube 80. The first cylindrical section 41 has an elongate bore 41*c* formed therein. The second cylindrical section 42 has an outer wall 42*a* and an inner wall 42*b* and an elongate bore 42*c*. The outer wall 42*a* forms a cylinder which is slightly smaller than the cylinder formed by the inner wall 65. The inner wall 42*b* forms a cylinder which is slightly larger than the probe receiving wall 66. There is a clearance of approximately 0.020" per side. This provides an interference or squeeze on an optional O-ring (not shown) which is not necessary, but may be utilized. Further, the end of the second cylindrical section 42 forms a v-shaped section 42*d* to further aid in alignment as will be discussed more fully hereafter. The intermediate section 43 has a central bore through which the needle 35 is inserted. The first cylindrical section 41 is larger than the opening of the cavity 60*a* so that it cannot pass into the cavity. The intermediate section has an angled surface 41*d* which forms a surface which engages the angled opening 60*b* of the cylindrical tube 61. The probe 40 is operatively connected to a base member 46. Preferably, the probe and base member 46 are formed as an integral one-piece unit. The base member 46 has a central portion 46*a*. The end sections have first and second distal apertures 46*b* and 46*c*. The base 46 has a first surface 46*d* and a second surface 46*e*. The second surface 46*e* is slightly concave such that the distance along the surface 46*c,* about its center line extending through the apertures, is raised.

A mounting bracket 36, having two end sections 36*a* and 36*b,* is mounted between the side members 23*b* of the upright member 23, by suitable means such as spot welds. The mounting bracket has three holes. The first is a central opening 37 through which the elbow 18 protrudes. An aligned hole (not shown) is also formed in the upright member 23 to allow for the delivery tube 80, which is connected to the elbow 18, to extend. Mounting holes 38 and 39 are formed in the mounting bracket 36 and are in general alignment with the first and second apertures 46*b* and 46*c*. Mounting bolts 47, each have a shaft 47*a* and head 47*b*. They are secured in place with a suitable nut 48. A washer 51 may be positioned between the heads 47*b* and the base member 46. Springs 50 are positioned around the shafts of the bolts 47, thereby urging the movable member toward the container and allowing the probe to pivot or rock. The size of the first and second distal apertures 46*b* and 46*c* are greater than the diameter of the shafts of the bolts 47. Therefore, there is play in the apertures. This allows for the probe to move upward, down or sideways or any combination thereof in response to contact with the container insert 60, as will be described more fully hereafter.

FIG. 10 is a perspective view of a second embodiment of a docking station, generally designated at 120. The docking station 120 includes an inner or first wire frame 121 and an outer or second frame member 131. The inner wire frame 121 has two base members 122 which are operatively connected to two front members 123. The base members 122 and front members 123 form a platform on which the container 11 rests. Upwardly extending front side members 124 are operatively connected to the front members 123. At the top of the front side members are operatively connected to angled members 125 which extend inward and are operatively connected to top members 126. The angled members 125 and top members 126 form a area where the upper handle of the container 11 may pass. To complete the inner wire frame 121, two back members 127 are operatively connected between the base members 122 and top members 126.

The outer wire frame 131 includes a back member 132 operatively connected to two side members 133, which are in turn connected to two downwardly depending front members 134. The front members 134 are operatively connected by a base member 135 which has an upwardly extending U-shaped section 135*a*. The outer frame 131 is connected to the inner frame 121 by suitable means, such as spot welding where members 133 cross members 124. While not shown, the mounting bracket 36 may be positioned between the top members 126 and the probe 40 connected to the mounting bracket 36 as in the prior embodiment. As the container 11 is placed on the base members 122, the container 11 is slid forward and contacts the probe. The container 11 is inserted, as this point, sufficiently so that the back end of the container is in front of the U-shaped section 135*a* and the section 135*a* acts much like the latch 25 in the first embodiment.

Figure 11:
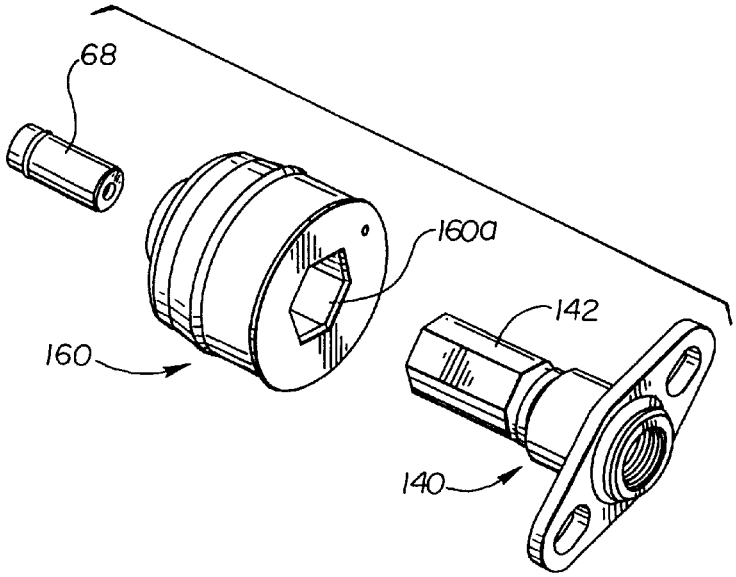
FIG. 11 is an exploded perspective view of a second embodiment of a probe and container insert.

Referring to FIG. 11, there is shown a second embodiment of the probe and container insert. The second embodiment is very similar to the first embodiment with the exception of a lockout feature being added to the probe and insert. As previously indicated, the probe 140 and cylinder insert 160 are nearly identical to the first probe 40 and first cylinder insert 60. The difference is that the outer configuration of the second cylindrical section 142 is not cylindrical, but is instead hexagonal. The cavity 160*a* has a matching cross-sectional configuration of a hexagon. The remainder of the second embodiment of the probes 140 and inserts 160 are similar to the first embodiment and will not be described in more detail. By having the outer cross-sectional configuration of the second cylinder 142 match that of the cavity 160*a*, a lockout feature is formed. Since the inserts 60 and 160 are carried by the container 11, the type of chemical product inside of the container 11 may be matched to the insert 60 or 160. Then, a matching probe 40 or 140 may be designated for receiving only certain types of chemicals. The cross-sectional configurations would be configured in size so that they would only match up with a corresponding cross-sectional configuration of the mating part. This would prevent the wrong chemical being dispensed. It is understood that a variety of cross-sectional configurations such as triangles, pentagons or star shapes may be used. Further, the sizes may be altered to assure that each configuration is unique and will not work with other configurations.

Figure 2:
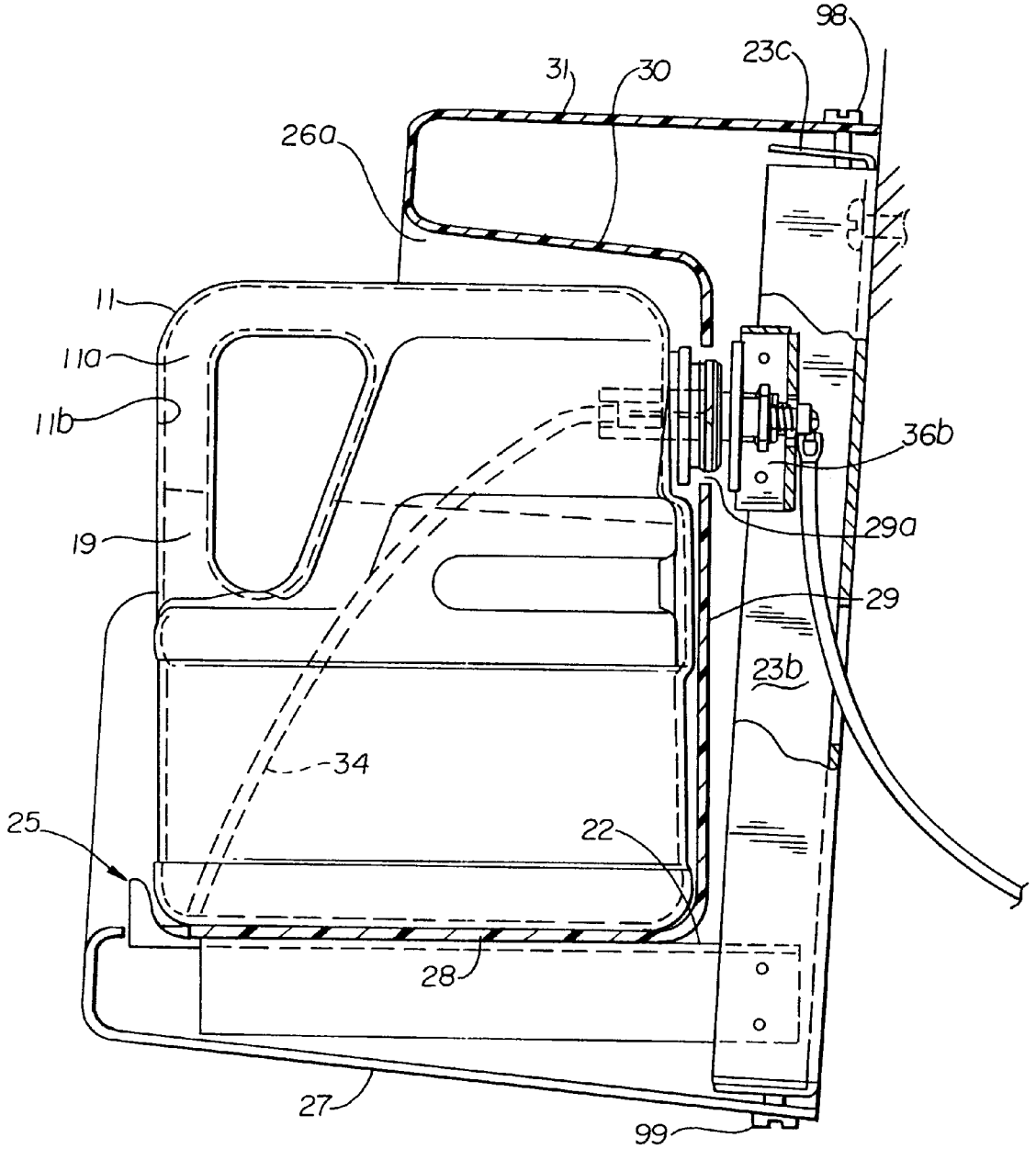
FIG. 2 is a cross-sectional view of the dispensing apparatus as shown in FIG. 1 taken generally along the lines 1—1.
Figure 7:
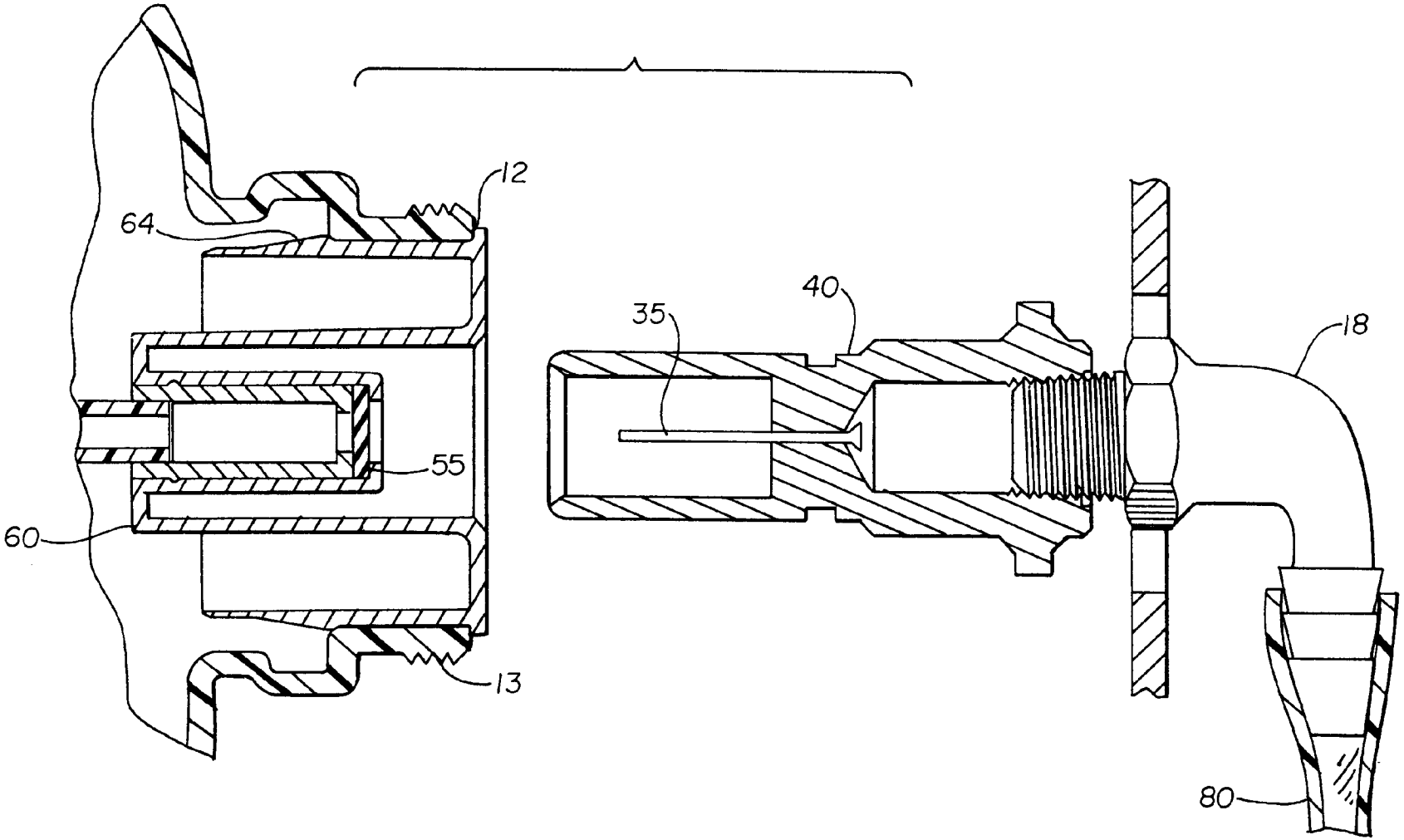
FIG. 7 is a schematic cross-sectional view of a portion of the dispensing apparatus shown in FIG. 1 showing the container prior to engagement of the probe.

The container 11 is filled with liquid product 19. Then, the container insert 60 is placed into the outlet 12 of the container 11. As can be seen best in FIG. 7, the insert 60 has a friction fit when it is in position in the container 11. The barb 64 provides an incline surface as the insert 60 is being inserted into the container. Then, the walls of container 11 snaps over the barb 64 and forms a friction fit. The barb 64 has a flat surface which is approximately parallel to the container and is larger than the outlet 12. This prevents the container insert 60 from being removed from the container. Removal of the container insert 60 would at least partially destroy the container 11. Then a threaded cap (not shown) is placed on the container for transport to the user. The pick-up tube 34 extends from the plug 68 at one end to its second end which is positioned proximate the far bottom corner of the container 11, as shown in FIG. 2.

Figure 4:
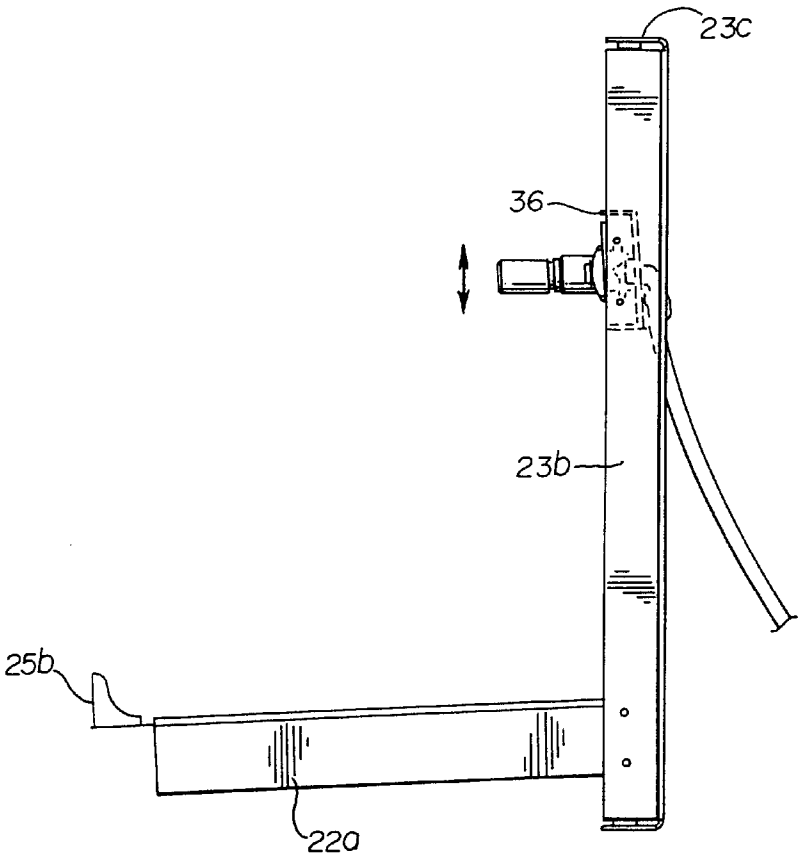
FIG. 4 is a side elevational view of the portion of the docking station shown in FIG. 3.
Figure 3:
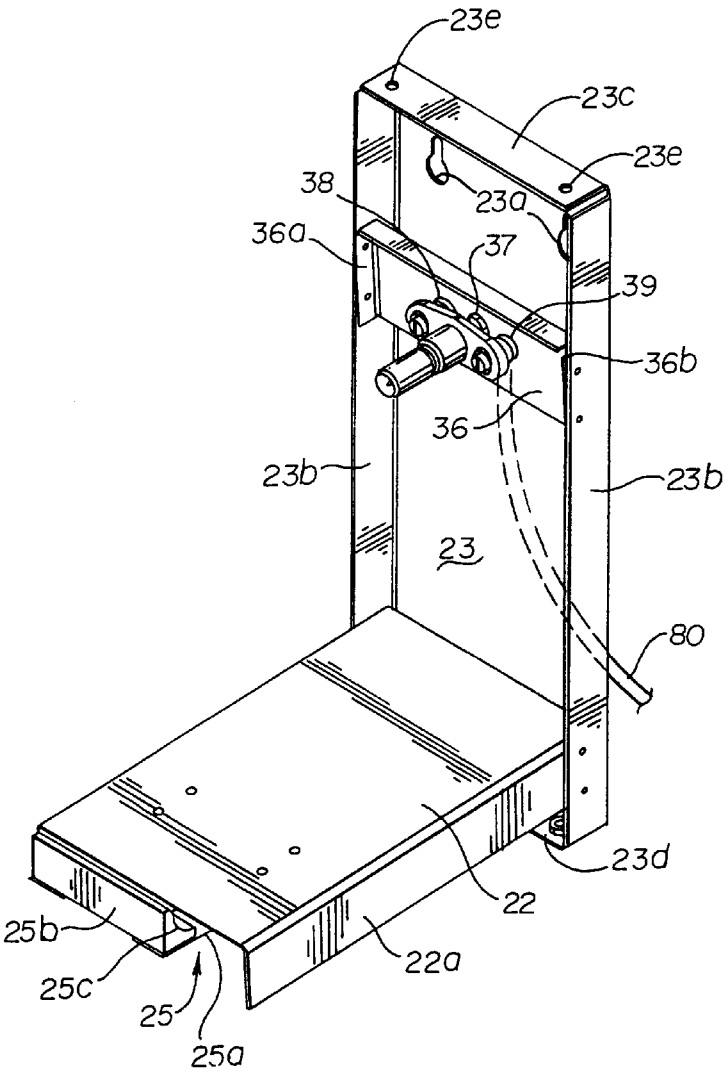
FIG. 3 is a perspective view of a portion of the docking station of the present invention.
Figure 6:
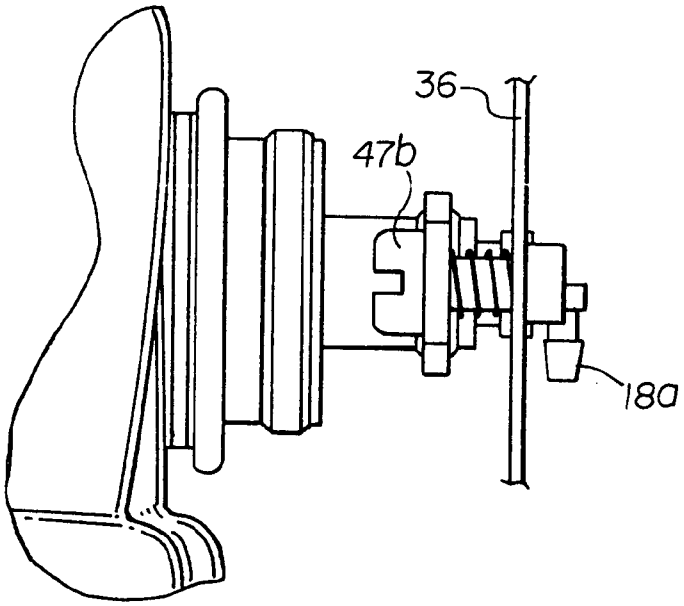
FIG. 6 is a side elevational view of the components shown in FIG. 5.
Figure 5:
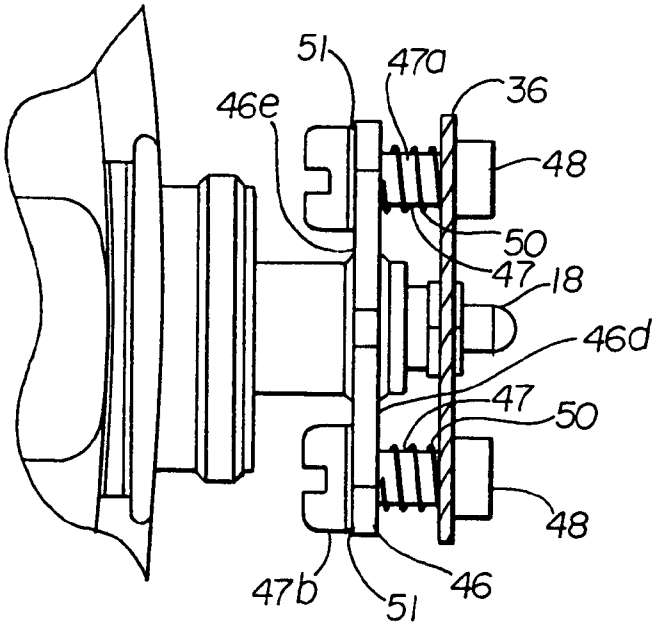
FIG. 5 is a top plan view of a portion of the present invention showing the probe and container insert.

When the liquid product is needed, the user removes the threaded cap. As the container 11 is moved toward the probe 40, the container is positioned over the latch 25. The latch 25 deflects downward and the container is moved closer toward the probe 40. Referring to the schematic drawing in FIG. 7, the end of the probe 46 begins to enter the cavity 60*a*. If the probe and the container insert were in perfect alignment, the probe would go in directly and be seated as shown in FIG. 9. However, with blow-molded injection containers and with a variety of operators, this is always not the case. The probe 40 begins to enter the cavity 60*a* of the container insert 60 and the v-shaped section ends 42*d* would typically come in contact with the inner wall 65. The force of the inner wall 65 contacting the probe 40 will cause the movable base member 46 to move in a direction dependent upon the force exerted by the inner wall as it is moved closer to the probe. In viewing FIG. 4, the probe is able to move either upward or downward as the top of the base member 46 would rock either in or out. If the distal ends of the base member 46 would go in or out, the probe would move either right or left depending upon the motion of the base member. Similarly, motions in-between the two previously described motions what occur if there was some combination of the movement of the base member 46. This alignment procedure continues until the probe 40 is in the position shown in FIG. 9.

As the probe continues to enter the container insert 60, the probe receiving wall 66 of the central cylindrical member 61*d* further assists in alignment. The alignment provides for a straighter puncturing of the septum 55 by the needle 35 and provides for preventing the septum from leaking by having a clean piercing motion. The product may then be delivered through the pick-up tube 34, through the needle 35, through the elbow 18 and finally out the delivery tube 80. The liquid product 19 may be dispensed by connecting the delivery tube 80 to an aspirator, peristaltic pump or other suitable means, well known in the art.

The present invention provides for a closed system package. The septum 55 seals the container 11. The liquid product 19 is able to be dispensed through the needle after it pierces the septum. However, the product cannot be poured out of the container after the needle is removed as the septum is self-sealing. By placing the container into the docking station, a hands-off connection is made. The needle, without guiding by a user, pierces the septum and the product is dispensed. No other connections are needed by the user. The container insert 60 cannot be removed without damaging or destroying the container 11. In addition, the vent 62 still provides for a closed system by the vent being constructed from a material that allows gas to pass through the vent but not a liquid. The present closed system dispenser is well suited for chemicals which should not come in contact with a user. The needle alignment mechanism of the probe 40 and movable member 45 allows for a clean and accurate piercing of the septum, thereby avoiding tears and resulting leakage.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An apparatus for dispensing fluid, comprising:

(a) a container for holding a liquid product to be dispensed;

(b) a docking station for receiving the container, the docking station having a support for holding the container;

(c) a pierceable self-sealing septum operatively connected to the container;

(d) a needle operatively connected to the docking station, the needle mounted on a movable mounting member with respect to the docking station whereby the needle is movable as the septum is moved proximate the needle to provide for alignment of the needle and septum; and (e) the needle having a first end for piercing the septum and for being in fluid communication with the liquid product and a second end for transferring the liquid product out of the container.

2. The apparatus of claim 1, further comprising the docking station having a recess into which the container is inserted and the needle is positioned in the recess.

3. The apparatus of claim 1, further comprising:

(a) a probe operatively connected to the docking system, and having an elongate bore in which the needle is positioned; and (b) a container insert operatively connected to the container, the insert having a cavity and the septum positioned in the cavity.

4. The apparatus of claim 3, further comprising a mounting member movably mounted to the docking station, the needle carried by the moveable mounting member.

5. The apparatus of claim 4, the mounting member comprising:

(a) a base member having a center section and first and second distal apertures;

(b) first and second mounting shafts, the first shaft having a first end operatively connected to the docking station and a second end positioned in the first aperture, the second shaft having a first end operatively connected to the docking station and a second end positioned in the second aperture, the base member movable on the shafts;

(c) the shafts having head members to limit movement away from the docking station; and (d) first and second springs mounted on the first and second shafts to urge the base member away from the docking station while still allowing movement toward the docking station to allow for alignment of the probe and container insert.

6. The apparatus of claim 5, wherein the shaft and head members comprise bolts having a shaft and head and washers are positioned between the heads and the mounting member, the mounting member having a concave surface proximate the washers, whereby alignment is further facilitated.

7. The apparatus of claim 6, wherein the probe is operatively connected to the base member.

8. The apparatus of claim 3, wherein the container insert comprises:

(a) a cylindrical tube having an outer wall and an inner wall, the outer wall sized to form a friction fit with an outlet in the container, the inner wall sized to accept the probe and to align the probe as it contacts the septum;

(b) a central cylinder operatively connected to the cylindrical tube, the central cylinder having a bore having a receiving end; and (c) a plug having a hollow core, the plug having a snap fit within the central cylinder and the septum fixed in place between the plug and the central cylinder proximate the receiving end.

9. The apparatus of claim 8, further comprising a barb around the outer wall to prevent removal of the insert after the snap fit has been established.

10. The apparatus of claim 1, further comprising:

(a) the probe having a given cross-sectional configuration; and (b) the cavity of the insert having a cross-sectional configuration matched to the cross-sectional configuration of the probe, wherein the probe and container insert form a lock-out combination.

11. An apparatus for dispensing fluids, comprising:

(a) a container having a cavity for holding a liquid product to be dispensed having a pierceable self-sealing septum located proximate a top of the container;

(b) a pick-up tube having a first end in fluid communication with the septum and a second end positioned proximate a bottom of the container;

(c) a docking station for receiving the container, the docking station having a support for holding the container;

(d) a needle operatively connected to the docking station;

(e) the septum operatively a closure which, after the closure is connected to the container, produces a closed system, wherein the needle pierces the septum in a hands-off connection, thereby allowing the liquid product to be pumped out of the container through the needle; thereby preventing contaminants from entering the cavity; and (f) a vent allowing gas to pass into the container but preventing liquid product from exiting the container through the vent, thereby keeping the system closed.

12. The apparatus of claim 11, further comprising the docking station having a recess in which the container is inserted and the needle is positioned in the recess.

13. The apparatus of claim 12, wherein the vent is made from polytetrafluoroethylene.

14. The apparatus of claim 13, further comprising a container insert, operatively connected to the container, the insert having a cavity and the septum positioned in the cavity, the vent positioned on the container insert.

15. The apparatus of claim 11, further comprising the support positioned at an angle to tilt the container, wherein the pick-up tube is disposed at a low end of the container, caused by the tilt, to allow for removal of the liquid product when it is substantially dispensed.

* * * * *